United States Patent [19]

Schmeykal et al.

[11] 4,251,010

[45] Feb. 17, 1981

[54] CERTIFICATE DISPENSER

[75] Inventors: Rudolf Schmeykal, Neuenbeken; Peter Weigel, Borchen-Doerenhagen, both of Fed. Rep. of Germany

[73] Assignee: Nixdorf Computer AG, Paderborn, Fed. Rep. of Germany

[21] Appl. No.: 894,592

[22] Filed: Apr. 7, 1978

[30] Foreign Application Priority Data

Apr. 19, 1977 [DE] Fed. Rep. of Germany ..... 2717345

[51] Int. Cl.[3] ..... B65H 5/06

[52] U.S. Cl. ..... 221/93; 221/129; 221/231; 221/279; 133/1 R; 209/534

[58] Field of Search ..... 221/92, 93, 94, 123, 221/124, 129, 133, 197, 198, 231, 279; 133/1 R, 4 R; 209/534, 909; 271/9, 122, 149, 150, 162, 164

[56] References Cited

U.S. PATENT DOCUMENTS

| | | | |
|---|---|---|---|
| 2,950,675 | 8/1960 | Copping et al. | 271/122 X |
| 3,138,322 | 6/1964 | Orlando | 271/149 X |
| 3,175,821 | 3/1965 | Gibson | 271/9 X |
| 3,976,198 | 8/1976 | Carnes et al. | 209/534 |
| 4,017,004 | 4/1977 | Onoe et al. | 221/94 |
| 4,066,253 | 1/1978 | Lundbald et al. | 271/9 X |

FOREIGN PATENT DOCUMENTS

| | | | |
|---|---|---|---|
| 2315470 | 1/1977 | France | 271/122 |

*Primary Examiner*—Joseph J. Rolla
*Attorney, Agent, or Firm*—Krass & Young

[57] ABSTRACT

A dispenser for bank notes and currency having a plurality of storage receptacles for bank notes and currencies of different denominations, each with a permanently assigned take-up device. A central conveyor line common to all of the storage receptacles leads to a delivery or filing position. The central conveyor line and the take-up devices are arranged between partly open limits of the storage receptacle and the central conveyor line includes driven guides for the certificates.

19 Claims, 4 Drawing Figures

CERTIFICATE DISPENSER

The invention relates to a dispenser for certificates with a plurality of storage receptacles for receiving in stack form various kinds of certificates preferably bank notes or valuable securities, with take-up devices permanently assigned to the individual storage receptacles and with a conveyor device common to all the storage receptacles, which conveyor leads to a filing position or delivery position which is likewise common to all the storage receptacles.

In a known certificate dispenser a plurality of storage receptacles are supported one above another on a rack. The storage receptacles individually assigned to the separate denominations are in an inclined position, so that the stack of certificates is pressed by gravity against the partially open front face of the storage reservoir. In the region of these front faces of the individual storage receptacles there are take-up devices with driven take-up rollers which can remove individual certificates from the storage receptacles. The certificates taken up are transferred to a conveying device, which conveying device is constructed as a collecting receptacle that can move in the manner of an elevator column of individual take-up devices of the storage receptacles. Thus, for every take-up action the conveying device is moved into the corresponding position in front of the particular storage receptacle and receives the taken-up certificate. The certificates collected in the conveying device are then conveyed by the movement of the conveying device to a point above the storage receptacle and by way of conveying means to a filing or delivery position. A disadvantage of this known device is that for each take-up action the movable conveying device must be moved in front of the storage receptacle involved, necessitating the provision of expensive guide and drive equipment and causing the removal and conveying actions to proceed the removal and conveying actions go relatively slowly, since each individual take-up action involves an elevator-like motion of the conveying device's collecting receptacle.

SUMMARY OF THE INVENTION

The present invention is directed toward designing a certificate dispenser of the type discussed above in such a way that its construction expense is reduced as compared with the usual certificate dispenser.

Another object is to produce a certificate dispenser in which the take-up and delivery speeds are increased over those of known dispensers.

Still another object is to produce a unit having substantially increased operating reliability.

These objects are achieved according to the present invention by having at least one central conveyor line extending along the take-up devices of all of the storage receptacles, into which conveyor line the take-up lines of the individual take-up devices empty at different points.

By virtue of having a central conveyor line common to all of the storage receptacles to which conveyor line certificates of varied types can be brought at any time and from any storage receptacle the need for a movable collecting or receiving receptacle is eliminated and the take-up and delivery speed is increased many times as compared with conventional certificate dispensers. In the various storage receptacles or in special storage magazines there may be stored for example bank notes of different denominations or of different currencies. After the selection and actuation of the take-up devices assigned to the desired storage receptacle, for example by means of an input keyboard, as is well known in the art, the certificates or bank notes are immediately taken up from the storage receptacle and transferred to the central conveyor line from which they are transferred to a filing or delivery position. It should be noted that in addition to bank notes, papers of any other type can be stored in the individual storage receptacles and dispensed by the means of this invention.

The conveying of the individual certificates from the take-up lines to the central conveyor line is facilitated, according to a further development of the invention, by providing at the points at which the take-up lines empty into the central conveyor line a sheet-metal guide connecting those lines with one another. Preferably, the sheet-metal guides have suitable pressure or guide rollers which assure an exact sliding of the certificate along the sheet-metal guides.

According to a further development of the invention, the back pressure rollers assigned to the belt conveyors of the central conveyor line as well as the sheet-metal guides are mounted on individual frames assigned to the different storage receptacles and to the take-up devices belonging to them, which frames are fastened in an easily releasable manner to the supporting beams carrying the storage receptacles and their take-up devices. The frames are capable of being attached to the supporting beams by means of quick-locking elements, preferably by spring-loaded locking means which engage locking slots. In this manner the mounting of the unit is substantially simplified and there is the capability of detaching the frame or frames in order to perform repair work on the individual take-up devices or storage receptacles.

In certificate dispensers of the type according to the present invention as well as in all fast-moving conveying devices which are intended for the conveying and delivery of individual certificates, documents, sheets, or the like, there is the problem of achieving an exact and very quick removal of the certificates, documents and the like at the end of the conveying route, i.e., the uniform and exact delivery of the certificates to the delivery point or the filing bin. Such a transfer is often hindered by a certain adhesive action between certificate and conveying means and also by the slow natural fallling speed of the very light certificates. These difficulties are solved in the present invention by having a powered endless conveyor belt made of elastic material arranged between the central conveyor line and the filing or delivery position, which conveyor belt has freely cut pointed segments positioned at short intervals along the length of the belt with their free ends pointing in the drive direction. These segments lie at least approximately in the conveying plane through the major part of the belt's circuit but when passing around the guide rollers in the region of the filing or delivery positons they come out of the conveying plane and force the conveyed certificates individually off of the conveyor line. By means of the pointed segments coming out of the belt's plane, the individual certificates are pushed into the filing bin and the certificates are positively prevented from adhering to the conveyor belt.

According to another feature of the invention, the entire series of the take-up and conveyor rollers forming the take-up lines from each of the storage receptacles can be driven by a common drive unit. Clutches, especially electrically actuatable clutches and preferably magnetic clutches, are provided between the supporting shafts of the otherwise freely rotatable take-up rollers and the common drive. The clutches are actuated when necessary by a control device which contains a preset delivery program or into which a delivery program can be manually input in accordance with the particular needs, after which the selected take-up devices are set into action to remove the certificates from the storage receptacles. Of particular advantage here is the use of a single drive motor which serves all of the storage receptacles, and which runs steadily and without interruption so as to lengthen its service life.

According to a further development of the invention, the take-up device of each storage receptacle is provided with at least one contrarotating roller tangent to the take-up line, the supporting shaft of which is preferably connected by means of a transmission drive with the drive for the take-up rollers. The contrarotating roller, which can be operated without interruption, makes sure that if two cetificates stick together and are erroneously taken up together, one certificate will be retained while the other certificate passes correctly through the conveyor line. To facilitate this, both the contrarotating rollers and the driving rollers which constitute the take-up line and are immediately adjacent one another have a comb-like profile with projecting roller segments spaced apart from one another. The roller segments of the contrarotating rollers are positioned so that they can be inserted into the recesses between the roller segments of the driving rollers. In this manner, the capability is offered of adjusting the insertion depth and thus the take-up forces to match the different grades of certificates.

According to another development of the invention, a pressure spring with comblike spring teeth is provided which enages the recesses between the roller segments and presses the taken-up certificate against the contrarotating rollers. The force of this pressure spring exerted on the contrarotating rollers or on the taken-up certificates also effectively assists the retaining action of the contrarotating rollers. For this it is advantageous for the pressure spring to be retractable during the take-up of certificates by the take-up roller from the contrarotating roller. Thereby, the normal take-up or conveying of the certificate is not interfered with. The pressure spring goes into action when the correctly conveyed certificate has already reached the driving roller and its pressure roller and an erroneously taken-up double certificate is still in the take-up region or in the region of the contrarotating roller.

In the described embodiment the drive element of a clutch preferably a wire spring clutch, which engages only upon rotation, is fastened to the supporting shaft of the take-up roller, and the pressure spring is supported directly or indirectly on a drive element tensioned by a return spring. The pressure spring thus rests on the contrarotating roller only when the take-up rollers are standing still, whereas the pressure spring is lifted off of the contrarotating rollers and the conveying line is released at the moment the take-up rollers are driven.

A further feature of the invention is the provision of a signal system, e.g. in the form of a light barrier, arranged in the take-up line, preferably at the level of the conveying rollers of each take-up device, which signal system can be activated by a taken-up certificate and cause the stopping of the clutch of the take-up rollers as well the pressing of the pressure spring on the contrarotating rollers during the passage of a certificate.

Moreover, according to the invention a central control is provided which is connected with the take-up devices of the individual storage receptacles and can be activated by a delivery program which preferably can be input manually into the control. The delivery program can for example be input into the control by means of a keyboard which can be actuated by the customer himself, after which the control brings about a simultaneous or else sequential actuation of the particular take-up devices which are assigned to the different types of certificates.

The servicing of the certificate dispenser described, especially in placing new certificates in the storage receptacles, is made considerably easier according to a further feature of the invention, by having receptacle frames into which are inserted storage magazines containing stacked certificates. The receptacle frames are open on the take-up side with supporting beams placed on them for the support of the take-up device, and are arranged on a rack spaced one above the other and preferably in an inclined position. It has already been mentioned that with the certificate dispenser according to the present invention, in a very short time nearly any desired amount of different certificates or different types of certificates can be ejected. It may be added that because the take-up and conveying lines are connected to one another with hardly any gap, even old, used and therefore largely irregular certificates, especially bank notes, can be taken up and conveyed to the delivery point without any problems. The above-described pointed belt insures a correct transfer, to the filing bin for example, even in the case of greasy bank notes. It may be mentioned further that the control equipment used for controlling the individual storage receptacles or their take-up devices consists largely of electronic components or sets of components and thus can be constructed to be very space-saving and can operate noiselessly. Moreover, it has been shown in practice that the certificate dispenser according to the invention, despite its high take-up and conveying speed, operates with extraordinarily little noise since in contrast to the known design described at the outset there is a complete lack of large moving masses.

SUMMARY OF THE DRAWINGS

Further details of the invention are seen from the embodiment example representated in the drawings and described below.

They show.

DETAILED DESCRIPTION OF THE SPECIFIC EMBODIMENTS

Figure 1:
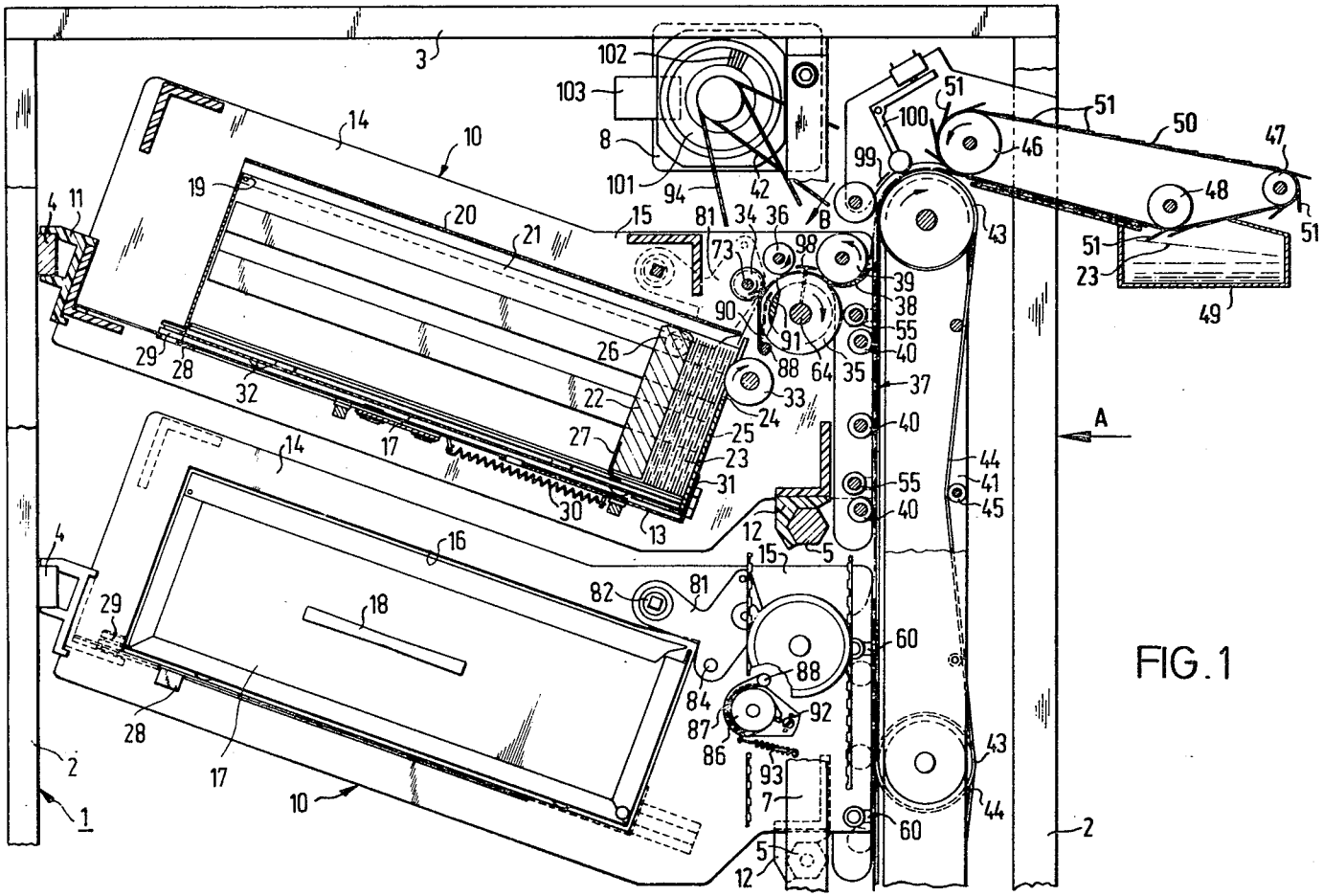
FIG. 1 shows a part of a certificate dispenser according to the invention in a schematic sectional representation along the section lines I—I of FIG. 2.

In the sectional representation according to FIG. 1, there is a rack 1 carrying the parts and assemblies of the certificate dispenser to be described, which rack in the preferred embodiment is composed of four vertical frame girders 2 as well as of upper and lower horizontal cross-beams 3 connecting the frame girders 2 together. The rack 1 also possesses rear supporting traverse bars 4 fastened onto the frame girders 2 and spaced one over another as well as supporting traverse bars 5 of hexagonal section, which are vertically staggered with respect to the supporting traverse bars 4 on the vertical supporting girders 7, represented only partly in FIG. 1.

The reference number 8 designates a drive motor fastened to the upper limit of the rack 1. Storage unit assemblies generally indicated at 10, rest on the supporting traverse bars 4 and 5 with a small vertical separation between one another and are supported by profiled supporting bars 11 and 12. Each of the storage assemblies 10 consists of a receptacle frame 13 with supporting plates 4 fastened thereto on both sides, which plates 14 jut out above the receptacle frames 13 near angular supporting beams 15. In FIG. 1, it is shown that one of the lateral supporting plates 14 has a rectangular-shaped opening 16 through which a storage magazine designated in general as 17 and equipped with a handle 18 can be inserted inside the receptacle frame 13. The storage magazine 17 itself has a cover 20 rotatable around the point of rotation 19 as well as guide bars 21 fastened onto the side walls of the magazine, on which bars is supported a flap-like pressure weight 22 constructed in the form of a plate, which is capable of moving freely along the guide bars 21. In each storage magazine 17 can be laid stacks of certificates 23, e.g. of bank notes of different denominations, where, due to the inclined arrangement of the receptacle frame 13 and of the storage magazine 17, the stack 23 of certificates is forced by gravity against the magazine wall 25 provided with cutouts 24. This is assisted by the pressure weight 22, which at its upper end is supported in a freely rotatable manner in the guide bars 21 by means of eccentrically situated small rollers 26. At its lower end the pressure weight 22 possesses an elastic tongue 27 which rests on the bottom of the magazine and thereby prevents the pressure weight 22 from sliding back away from the stack of certificates when the storage magazine 17 removed from the receptacle frame is swung toward the back, thus insuring that the stack of certificates 23 remains in the correct position.

On the bottom of each receptacle frame 13 is supported a rocking lever 28 provided with a handle and not further represented, which carries a tong 29 projecting into the interior of the receptacle, which tong 29 can engage a cutout on the inserted storage magazine 17. When rocking lever 28 is swivelled the storage magazine 17 is moved on sliding means 32 from the position shown in FIG. 1 on the lower storage receptacle into the position shown in FIG. 1 on the upper storage receptacle, this shift being counter to the force of a return spring 30 in this second position the storage magazine 17 is pushed toward the front limiting part 31 of the receptacle frame 13 until it strikes the limiting part and is locked there. In a manner not further represented, the individual storage magazines 17 as well as the receptacle frames 13 have coding elements individually assigned to one another which intermesh with one another when the storage magazines 17 in question are shifted, though only when the particular storage magazine is in the receptacle frame assigned to it. In this manner, possibly through electrical equipment, it can be verified whether the correct storage magazine is seated in the proper receptacle frame or in the proper storage assembly 10.

On the supporting plates 15 of the individual storage assemblies 10 are supported the take-up equipment, to be later discussed in detail, consisting of take-up rollers 33, contrarotating rollers 34, driving rollers 35 and pressure rollers 36. Frames 37, represented in more detail in FIG. 2, can be fastened by means of a quick-locking device onto the supporting plates 15, are assigned to the individual storage assemblies 10 and support sheet-metal guides 38 and the corresponding idling pressure rollers 39 as well as back pressure rollers 40, among others. Onto the vertical front side of the rack 1 is fastened a frame 41 which carries belt idlers 43 which can be driven by the drive motor 8 by means of drive belts 42, endless conveyor belts 44 and tension rollers 45. Also, the above-mentioned frame 41 can be fastened to the rack 1, by quick-locking devices. Preferably, the frame 41 is pivoted on the rack 1 to afford good accessibility to the storage assemblies 10 when necessary. Moreover, the rack 1 has supporting beams for drivable belt idlers 46, 47, 48 on which is mounted a conveyor belt 50 leading to a filing or delivery position 49. As is indicated in FIG. 1, the endless conveyor belt 50 has in its longitudinal direction pointed segments 51 at short intervals, which are attached to the belt 50 along one edge and are wedge-shaped at their free ends. The segments 51 lie at least approximately in the conveying plane when the conveyor belt is running straight between two rollers, but at the turning points, that is on the rollers 48 in the region of the filing or delivery station, they go out of the conveying plane and the certificates 23 being conveyed are individually forced away from the conveyor line. The travelling band conveyor 44 and conveyor belts 50 constitute conveyor lines which empty into one another and which serve for the collecting and conveying of certificates 23 taken out of the individual storage assemblies 10. The conveyor line extending along the take-up devices of the different storage receptacles or storage assemblies can consist of a plurality of travelling belt conveyors connected in tandem. Thus, for example, two travelling band conveyors 44 running parallel can be supported on the belt idlers 43 and travelling band conveyors 44 which are displaced sideways and lead further downward can be linked up to the lower belt idler 43 in FIG. 1.

Figure 2:
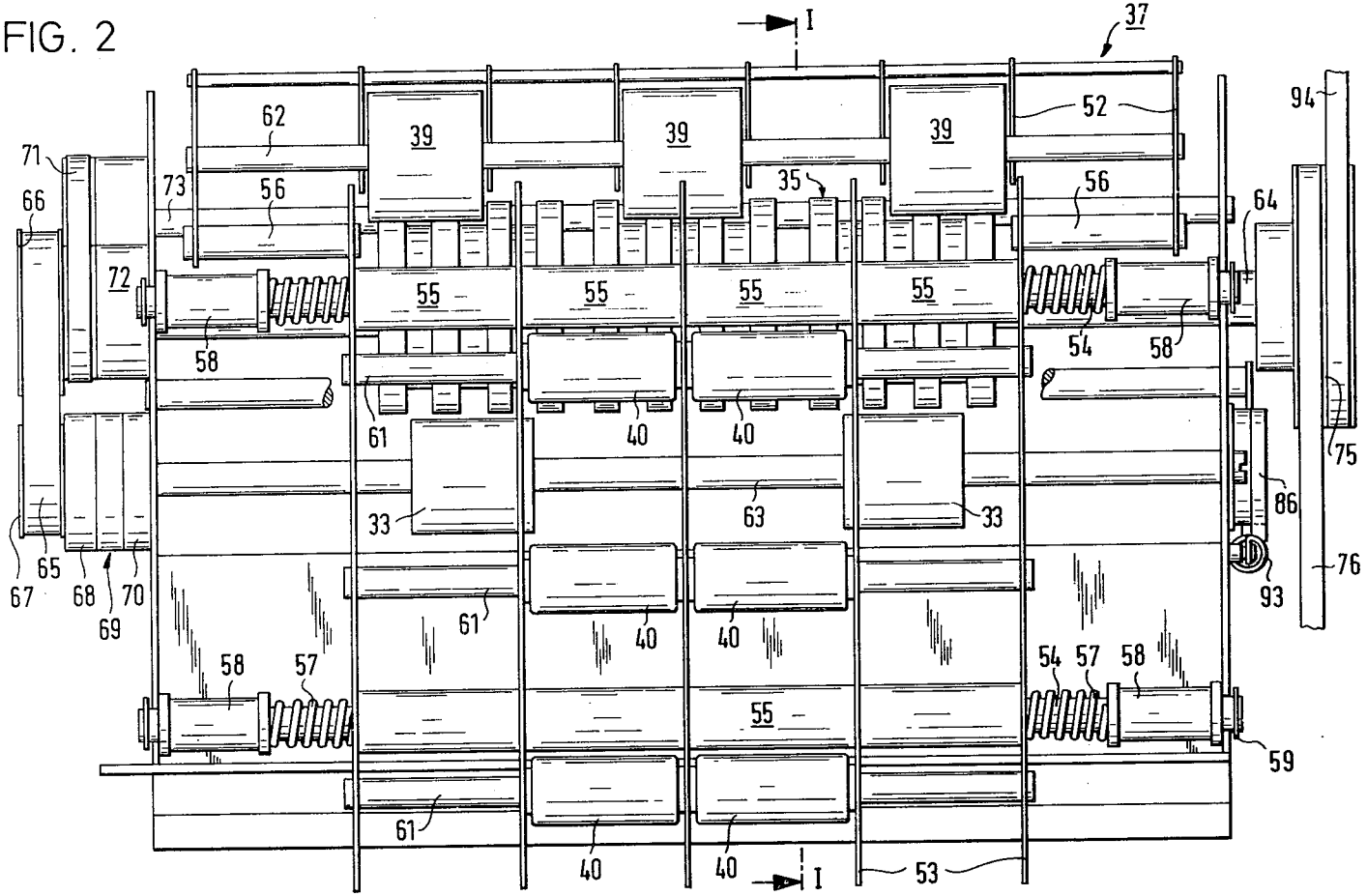
FIG. 2 shows a front elevation of the certificate dispenser according to FIG. 1 in the viewing direction A.

FIG. 2 shows a frame 37 assigned to a storage assembly 10, which frame consists of frame plates 52 and 53 arranged parallel to one another and held together by connecting belt 56 and by shafts 54 with spacing rollers 55 arranged between the frames 53. The quick-locking elements mentioned earlier consist of pressure sleeves 58 which can be moved counter to the force of the springs 57 on the shafts 54, which sleeves after being pushed back release a section of the shaft 54 limited by a spring washer, which then can be inserted in locking slots 60 open on one side of the supporting plates 14 (see also FIG. 4) and locked after releasing the pressure sleeves 58. Moreover, the frame 37 carries the free-running back pressure rollers 40 on shafts 61 as well as the pressure rollers 39 on shafts 62 held between the frame plates 52, as mentioned earlier.

Figure 3:
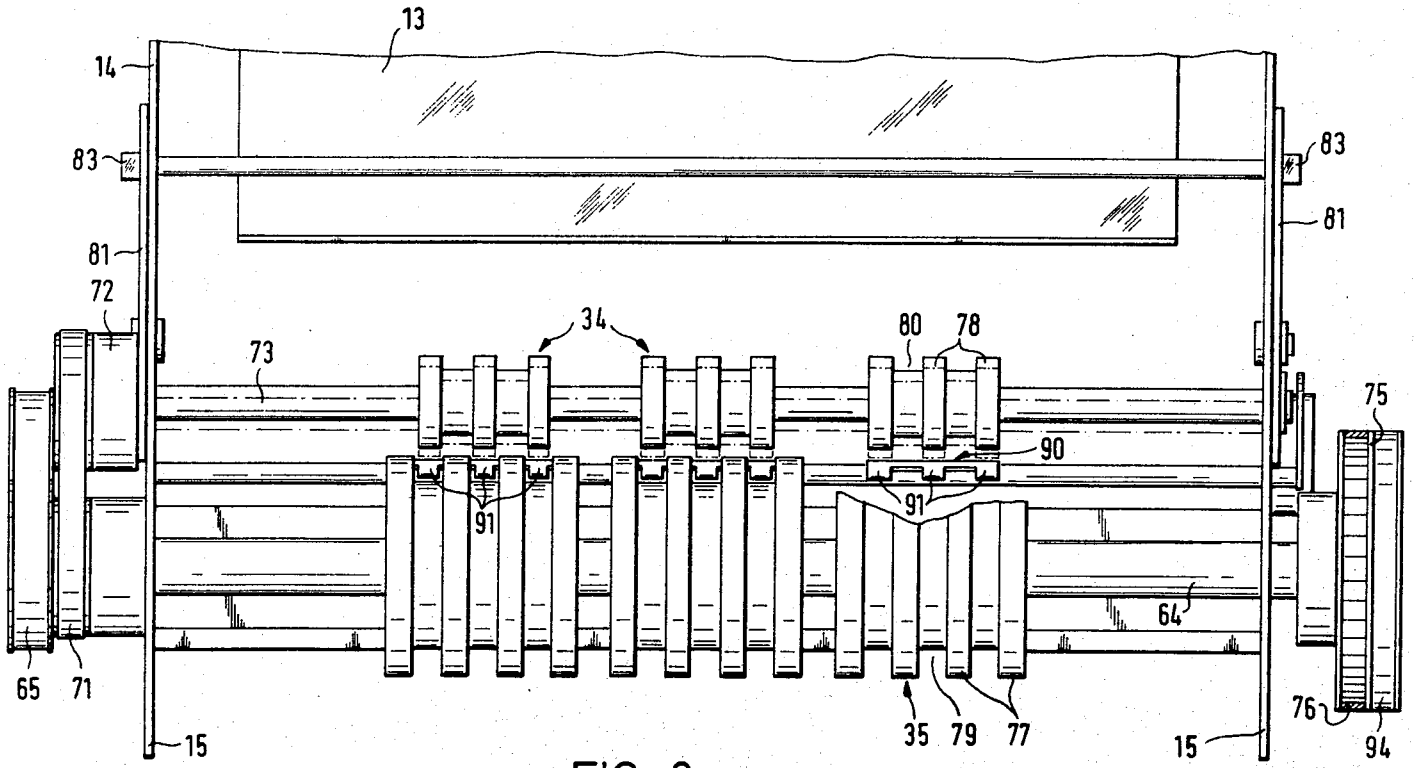
FIG. 3 shows part of the certificate dispenser in a top plan view according to the view direction B in FIG. 1.
Figure 4:
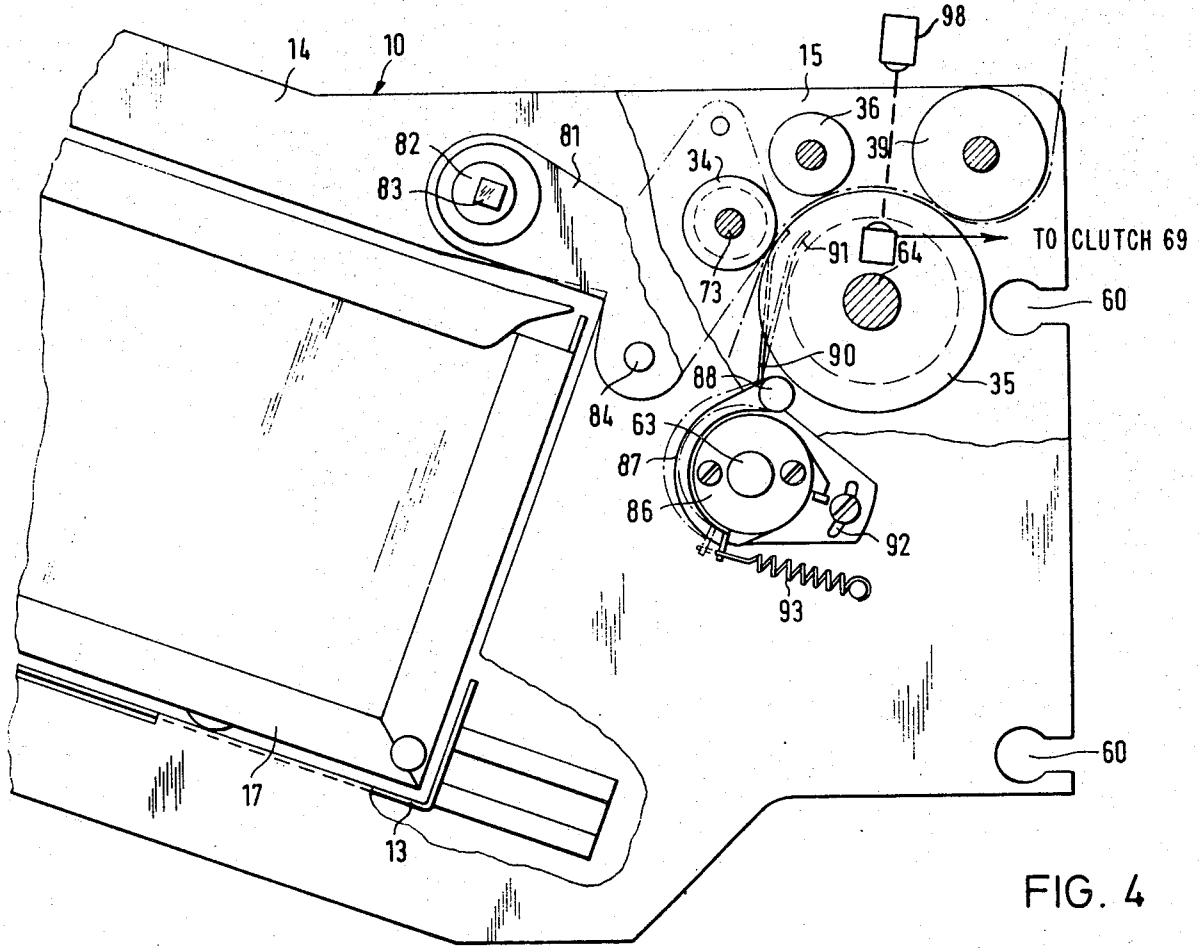
FIG. 4 shows a detail of the certificate dispenser in an enlarged side elevation.

FIGS. 2, 3 and 4 together with FIG. 1 show the construction of the take-up device of a storage assembly 10. In the preferred embodiment, two take-up rollers 33 engaged in the cutouts 24 (FIG. 1) are mounted on a supporting shaft 63 held between the lateral supporting plates 14 in the region of the beam sections 15. For sake of visibility, the take-up rollers 33 are not represented in FIG. 4. The supporting shaft 64 of the driving roller 35 is coupled by way of a belt drive 65 and associated belt pulleys 66, 67, with the drive side 68 of an electrically actuatable magnetic clutch 69 which is known in the art. The driving side 70 of the magnetic clutch 69 is connected with the supporting shaft 63 of the essentially idling take-up rollers 33. The supporting shaft 64 of the driving rollers 35 is likewise in a drive connection with the supporting shaft 73 of contrarotating rollers 34 by way of a belt drive 71 and indirectly by way of a transmission gearing with a transmission ratio of 1:20. On the other side of the supporting plate, the supporting shaft 64 of the driving rollers 35 carries twin belt pulleys 75 which receive the driving belt 92 which is connected with the drive motor 8 (FIG. 1) and a driving belt 76 leading to the next storage assembly 10. FIG. 3 clearly shows that both the driving rollers 35 and the contrarotating rollers 34 have a comb-like appearance. Roller segments 77 and 78 project radially from their respective spaced apart shafts 64 and 73 and define recesses 79 and 80 therebetween with the roller segments 77 and 78 aligned opposite recesses 79 and 80. It can be seen from FIGS. 1, 3 and 4 that the contrarotating rollers 34 and their supporting shaft 73 are mounted on supporting rocker arms 81 arranged on both sides of the receptacle frame 13 of the storage assembly 10, which arms in turn are attached to the supporting plates 15 by way of an eccentric drive 82 with a square-headed extension 83, whereby rotation of the square-headed extension 83 causes the rocker arms 81 to be rotated around the pivot point 84, so that the roller segments 78 of the contrarotating rollers 34 are moved to mesh with the recesses 79 of the driving roller 35.

It can also be seen from FIGS. 1, 3 and 4 that at one end of the supporting shaft 63 for the take-up rollers 33 is arranged a wire spring clutch 86 the driving element of which is connected directly with the supporting shaft 63 and the driven element of which, can be engaged with the driving element by way of a wire spring upon rotation of the supporting shaft 63. The clutch 86 includes a sickle-shaped lever 87 pivotally mounted at 88 and onto which is fastened a pressure spring 90 which has spring teeth 91 engaging in the recesses 79 of the driving roller 35. The wire spring clutch 86 or the swiveling stroke of its driving element is adjustable by means of a guide slot 92 and is under the action of a return spring 93. When the supporting shaft 63 rotates, the pressure spring 90, as is denoted in broken lines, is lifted from the contrarotating rollers 34, whereas when the supporting shaft 63 is stopped the pressure spring with its spring teeth 91 presses against the roller segments 78 of the contrarotating roller 34 through the action of the return spring 93.

In the following the mode of operation of the certificate dispenser described is explained, while at the same time further construction details are described.

It has already been mentioned that bank notes, for example, of different denominations can be placed in stacks in the separate storage magazines 17. For this purpose the certificate dispenser has in practice more than two storage assemblies arranged one over another in an inclined position. The drive of the take-up devices of the individual storage assemblies 10, the drive of the travelling band conveyor or conveyors 44 which form a central vertical conveyor line in combination with the back pressure rollers 40, and the conveyor belt 50, which likewise constitutes a central conveyor line, are, as explained, driven by driving belts 42, 94 from the central drive motor 8. The certificate dispenser has a control device, not represented further, which is connected by electric lines with the take-up mechanisms or with the magnetic clutches 69 of the individual storage assemblies 10. By means of a keyboard, for example, a certain delivery program, i.e. a certain amount of money to be delivered from the certificate dispenser is input into the control device. Following this, by means of electronic equipment the take-up devices of the storage assemblies 10 are triggered by the control device, that is, the respective magnetic clutches 69 are fed current simultaneously or preferably one after another. The result is that the supporting shafts 63 of the respective take-up rollers 33 are coupled with the drive so that the take-up rollers 33 turn in the direction of the arrow. Thereby the first certificate 23 in line is withdrawn from the storage magazine 17 and sent to the take-up line constituted by the conveying rollers 35, the contrarotating rollers 34, the pressure rollers 36 and the pressure rollers 38. The contrarotating roller 34, turning relatively slowly counter to the conveying direction, prevents any two papers that may be stuck together from passing between the driving roller 35 and its pressure roller 36 by separating the contrarotating rollers 34 retain such a double paper. During this take-up process the pressure springs 90 are lifted up off the contrarotating rollers 34 (broken-line position). The conveyed certificate is now picked up by the driving roller 35 in combination with the pressure roller 36. At the level of the driving roller 35 there is a signal system 98 in the form of a so-called light barrier for example. As the certificate first reaches this signal system 98, the signal system is actuated (start of certificate). The signal system 98 operates to stop the magnetic clutch 69 as well as the take-up rollers 33. Directly coupled with this is a motion of the pressure spring 90 in the direction of the contrarotating rollers 34, which reinforces the retaining effect of the contrarotating rollers 34 in the presence of a double thickness of paper. The correctly conveyed certificate 23 passes through the signal system 98, whereupon after the certificate is taken up the magnetic clutch 69 is again automatically brought into the engaged position and the take-up rollers 33 rotate again and if required take up further certificates 23 from the storage magazine. The correctly conveyed certificate passes through the sheet-metal guide 38 and is sent to the central vertical conveyor line, i.e., to the travelling band conveyor 44. At the level of the belt idler 43 at the upper end of the vertical conveyor line is a second signal system 99 which is connected with a counter by which the arriving certificates can be counted. Also, at this point is positioned a device 100 for measuring the thickness of the arriving certificates by means of which, for example, erroneously conveyed double papers can be identified. Flanged on the central drive motor 8 for rotation thereby is a pulse disk 101 with impulse grooves 102 and with a sensing element 103, by means of which pulses produced between the signal for start of certificate and end of certificate a defined by the signal system 98 are counted. In this way certificates of different lengths can be identified. If all interrogation signals with the pulse disk 101 are in order and no double certificate is detected and the correct length of certificate is recognized, then the certificates arriving from the different storage assemblies 10 and transported in the central conveyor line are immediately forwarded to the filing or delivery position or straight to the customer by means of the conveyor belt 50. If indicating signals do not occur or the presence of a double or wrong certificate is detected, all of the certificates are conveyed back into a retaining bin which is not further represented.

It is to be understood that the invention has been described with reference to specific illustrative embodiments and that the foregoing description is not to be construed in a limiting sense.

The embodiments of the invention in which an exclusive property or privilege is claimed are defined as follows:

1. A certificate dispenser of the type including a plurality of certificate magazines disposed within a dispenser housing in vertically spaced relation and containing certificates such as bank notes which are to be dispensed in a programmed fashion wherein the improvement comprises:

a plurality of individual take-up roller systems operatively associates with respective magazines, each of said roller systems comprising a take-up roller contacting the first certificate of a stack of certificates in the associated magazines and operable upon rotation to remove said certificate from the magazine;

each of said roller systems further comprising feed and pressure rollers to advance a certificate received thereby through a first path;

means for selectively actuating each of said take-up rollers;

an endless belt conveyor extending along a second vertical path which is commonly adjacent and contiguous to each of said first paths of said take-up roller systems to receive certificates from said first paths and to carry said certificates along said second path, said second path being independent of each of said first paths;

and means independent of said conveyor but contiguous therewith for collecting the certificates withdrawn from the magazine, said certificate dispenser further including within each of said take-up roller systems a counter-rotating roller for separating double certificates inadvertently simultaneously removed from the associated magazine, and selectively operated means for urging certificates against said counter-rotating rollers.

2. Apparatus as defined in claim 1 wherein said means for collecting certificates comprises a second conveyor defining a third path contiguous with the second path for receiving certificates from said second path and further comprising means for positively discharging certificates from the third path conveyor toward a collection zone.

3. Apparatus as defined in claim 1 wherein the means for selectively actuating each of said take-up rollers comprises an electric clutch.

4. Apparatus as defined in claim 1 further including a light barrier signal system disposed between the rollers of said take-up roller system for detecting the presence of a certificate and for deactivating said means for selectively activiating each of said take-up rollers.

5. Apparatus as defined in claim 1 wherein said selectively operated means is operatively connected to the take-up roller to be operated whenever the take-up roller is de-actuated.

6. Certificate dispenser as defined in claim 5 wherein the second conveyor is between the first conveyor and the collection zone and comprises an endless drivable conveyor belt of elastic material, which in its longitudinal direction has at short intervals pointed segments freely cut and with their free ends toward the driving direction, which when the conveyor belt moves in a straight line are located at least partly in the conveying plane and at turning points in the region of the filling or delivery position come out of the conveying plane and force and conveyed certificates individually off of the conveyor line.

7. Certificate dispenser as claimed in claim 6, characterized in that the freely cut pointed sections are designed in wedge form.

8. Apparatus as defined in claim 1 further including support means for receiving certificate magazines and supporting said magazines in an angled disposition wherein a lowermost end of each of said magazines is adjacent a take-up roller such that the lowermost certificate in said magazine contacts said roller;

and gravity operated weight means slidably disposed within each of said magazines for urging the certificates toward the take-up roller by force of gravity.

9. Certificate dispenser as defined in claim 8, wherein each certificate magazine's receiving means includes a thrust mechanism with a manually operable rocking lever as well as with a cam fastened onto the rocking lever through which the inserted storage magazines can be shoved counter to the force of a return spring into the take-up position and be locked in this position.

10. Certificate dispenser as claimed in claim 9, characterized in that guide bars are provided in the receptacle frame for the storage magazines with coding elements individually assigned to the latter.

11. Certificate dispenser as claimed in claim 10, characterized in that in each storage magazine is provided a pressure weight, preferably in plate form and freely movable, which presses the stack of certificates against the take-up rollers.

12. Certificate dispenser as claimed in claim 11, characterized in that the pressure weight on its top end is mounted eccentrically on an axis of rotation and on its lower end adjacent to the bottom of the magazine it possesses an elastic tongue, which, when the pressure weight swivels in a direction leading away from the stack of certificates, strikes against the magazine bottom and therewith retains the pressure weight.

13. Certificate dispenser as claimed in claim 1, characterized in that the supporting shaft of the contrarotating roller or rollers is mounted on rocker arms which can preferably be moved by an eccentric drive, in such a way that the contrarotating rollers are brought closer to and moved away from the driven conveying rollers serving to convey the certificate.

14. Certificate dispenser as claimed in claim 13, characterized in that both the contrarotating rollers and the driving rollers possess a comb-like profile with roller segments spaced apart from one another and constituting the take-up line, and that the roller segments of the contrarotating rollers dip into the sections between the roller segments of the driving rollers.

15. Certificate dispenser as claimed in claim 14, characterized in that a pressure spring is provided which forces the taken-up certificates against the contrarotating rollers and is equipped with comb-like spring teeth engaging in the recesses between the roller segments of the driving roller.

16. Certificate dispenser as claimed in claim 15, wherein means are provided to lift the pressure spring from the contrarotating roller during the take-up of the certificates by the take-up rollers.

17. Certificate dispenser as claimed in claim 16, wherein means are provided to couple the pressure spring with the driven supporting shaft of the take-up rollers to perform the lifting motion.

18. Certificate dispenser as claimed in claim 16, characterized in that onto the supporting shaft of the take-up rollers is attached a clutch which engages only upon the rotation of the supporting shaft, preferably a wire spring clutch, and that the pressure spring is indirectly or directly supported on the driving element of the clutch which element is tensioned by a return spring.

19. Certificate dispenser as claimed in claim 18, characterized in that the rotation range of the driving element of the clutch is adjustable.

* * * * *